US012691322B2

(12) United States Patent
Biscarini et al.

(10) Patent No.: US 12,691,322 B2
(45) Date of Patent: Jul. 28, 2026

(54) GYMNASTIC MACHINE FOR TRAINING THE TRUNK MUSCLES, COMPRISING IMPROVED LEVERS

(71) Applicant: TECHNOGYM S.P.A., Cesena FC (IT)

(72) Inventors: Andrea Biscarini, Cesena FC (IT); Luca Zoffoli, Cesena FC (IT); Andrea Rocco Galante, Cesena FC (IT)

(73) Assignee: TECHNOGYM S.P.A., Cesena FC (IT)

( * ) Notice: Subject to any disclaimer, the term of this patent is extended or adjusted under 35 U.S.C. 154(b) by 37 days.

(21) Appl. No.: 18/506,943

(22) Filed: Nov. 10, 2023

(65) Prior Publication Data

US 2024/0216748 A1 Jul. 4, 2024

(30) Foreign Application Priority Data

Nov. 18, 2022 (IT) ..... 102022000023844

(51) Int. Cl.
*A63B 21/00* (2006.01)
*A63B 21/005* (2006.01)
(Continued)

(52) U.S. Cl.
CPC ..... *A63B 21/159* (2013.01); *A63B 21/005* (2013.01); *A63B 21/0628* (2015.10);
(Continued)

(58) Field of Classification Search
CPC . A63B 21/005; A63B 21/0628; A63B 21/152; A63B 21/154; A63B 21/159;
(Continued)

(56) References Cited

U.S. PATENT DOCUMENTS 4,494,751 A * 1/1985 Schnell ..... A63B 23/03533 482/136
5,554,083 A 9/1996 Chen
(Continued)

FOREIGN PATENT DOCUMENTS

EP 2 589 417 5/2013
FR 2 544 618 10/1984
(Continued)

OTHER PUBLICATIONS

Italian Search Report for Italian Patent Application No. 102022000023844 dated Jun. 19, 2023 in 8 pages.

*Primary Examiner* — Joshua Lee
(74) *Attorney, Agent, or Firm* — Knobbe, Martens, Olson & Bear, LLP

(57) ABSTRACT

A gymnastic machine for training trunk and shoulder muscles includes a frame, a first lever, and a second lever. The levers are pivotally coupled to the frame and connected to a resistance device. The first lever includes a first reference element and the second lever includes a second reference element. When a user grips the handles of the levers to perform an exercise, the reference elements are positioned to extend below the user's forearms. The reference elements act as a guide to ensure the user maintains their arms in a correct, substantially horizontal position throughout the movement. This helps to ensure proper activation of the target muscles and prevents incorrect posture, such as dropping the elbows, during the exercise.

9 Claims, 4 Drawing Sheets

(51) Int. Cl.
*A63B 21/062* (2006.01)
*A63B 23/02* (2006.01)
*A63B 23/035* (2006.01)
*A63B 23/12* (2006.01)

(52) U.S. Cl.
CPC ..... *A63B 21/154* (2013.01); *A63B 21/4035* (2015.10); *A63B 21/4047* (2015.10); *A63B 23/02* (2013.01); *A63B 23/03541* (2013.01); *A63B 23/1245* (2013.01)

(58) Field of Classification Search
CPC . A63B 21/4035; A63B 21/4047; A63B 23/02; A63B 23/03541; A63B 23/1245; A63B 23/1254
See application file for complete search history.

(56) References Cited

U.S. PATENT DOCUMENTS 5,613,928 A * 3/1997 Laudone ..... A63B 23/03533 482/99
7,322,906 B2 * 1/2008 Webber ..... A63B 21/4047 482/137
7,393,310 B2 * 7/2008 Andrews ..... A63B 23/1245 482/131
7,601,108 B2 * 10/2009 Andrews ..... A61H 1/0281 482/131
7,731,642 B2 * 6/2010 Kashiwaya ..... A63B 69/0057 482/136
7,833,138 B1 11/2010 Fulks
8,075,459 B2 * 12/2011 Axelsson ..... A63B 23/1281 482/136
9,095,492 B2 * 8/2015 Verkaaik ..... A63B 21/012
9,126,081 B2 * 9/2015 Hockridge ..... A63B 23/1272
9,682,276 B2 * 6/2017 Hockridge ..... A63B 23/1245
10,799,756 B2 * 10/2020 Tuononen ..... A63B 21/0628
2003/0144116 A1 7/2003 Carter
2010/0190617 A1 7/2010 Gautier
2011/0224052 A1 * 9/2011 Webber ..... A63B 21/4047 482/94
2013/0109542 A1 * 5/2013 Hockridge ..... A63B 21/0628 482/94
2019/0111312 A1 * 4/2019 Taivainen ..... A61H 1/0281

FOREIGN PATENT DOCUMENTS

WO WO 02/38230 5/2002
WO WO 2004/009184 1/2004

* cited by examiner

GYMNASTIC MACHINE FOR TRAINING THE TRUNK MUSCLES, COMPRISING IMPROVED LEVERS

The present invention concerns a gymnastic machine for training the muscles of the trunk and shoulder girdle comprising improved levers, in particular for stabilizing the upper limbs during the execution of exercises.

FIELD OF INVENTION

More in detail, the invention concerns a gymnastic machine of the aforementioned type, designed and realized in particular for the training of muscles that mobilize/stabilize the shoulder, mainly the posterior deltoid, infraspinatus, teres minor, and latissimus dorsi, and muscles which mobilize/stabilize the scapula, mainly rhomboids and middle bundles of the trapezius, including improved levers for performing the exercises, but which can be used for any muscle group of the trunk and shoulder girdle.

In the following, the description will be directed to a gymnastic machine for training the shoulder and scapular muscles including improved levers, but it is clear that it should not be considered limited to this specific use.

PRIOR ART

As is well known, currently for the training of the muscles of the trunk and the shoulder girdle, and the lateral muscles, specific exercises are performed typically while sitting, in order to control the structure of the physiological curves of the spinal column, which undergoes considerable stress during execution of the same.

It is possible to perform exercises using free weights.

Gymnastic machines have also become widespread to perform exercises in a more controlled way, including a seat for the user, a pair of levers, which can be gripped by the respective right and left hands, connected by cables to a resistance device.

Typically, the user sits on the seat, leans on a support with his back or stomach, holds a lever with his right hand and another lever with his left hand and pulls the levers overcoming the force of load of the resistance device.

The exercise therefore includes a concentric phase, in which the user brings the levers closer to him, and an eccentric phase, in which the user must control the return of the levers to the starting position, which would otherwise occur impulsively under the action of the external load.

Currently, in existing machines, the spontaneous recruitment of a more efficient muscle chain tends to bring the elbows downwards, both during the concentric phase and during the eccentric phase, well below the level of the handles and therefore of the hands.

This causes a number of undesired effects, such as loss of alignment of the wrist when it is in full flexion, which can cause potentially dangerous mechanical stress on the wrist.

Furthermore, lowering the elbow during the execution of the exercises causes the movement plane of the shoulder to change from the transverse plane, to a plane that approaches the sagittal plane, with a change in the movement of the shoulder and scapula, and a change in activation of the glenohumeral and scapular target muscles.

Performing the exercises with the lowered elbows also causes the implementation of undesired physical compensations such as the anterior inclination of the shoulder blades, inducing a kyphotic attitude.

Therefore, to overcome these serious drawbacks, in the use of known gymnastic machines, it is necessary a continuous supervision by a trainer, who must systematically assist the user of the machine during the execution of the exercise so that the elbows are kept raised to the level of the wrists.

PURPOSE OF THE INVENTION

In light of the above, it is therefore the purpose of the present invention to provide a gymnastic machine for performing exercises to strengthen the muscles of the trunk and shoulder girdle, which allows the user to maintain a position of the arms suitable for a correct execution of the exercise.

Another purpose of the invention is to provide a gymnastic machine for performing exercises to strengthen the muscles of the trunk and shoulder girdle that allows the muscles involved in the strengthening exercise to be correctly activated.

OBJECT OF THE INVENTION

It is, therefore, specific object of the present invention a gymnastic machine for training the trunk muscles and shoulder cingulum comprising a frame for resting said gymnastic machine on the ground or on a base, a first lever, comprising a first handle which can be gripped by the user, coupled to said frame in a first fixed fulcrum and capable of rotating around said first fixed fulcrum according to a first direction of rotation, from a first position to a second position, a second lever, comprising a second handle which can be gripped by the user, coupled to said frame in a second fixed fulcrum and capable of rotating around said second fixed fulcrum according to a second direction of rotation, opposite to said first direction of rotation, from a first position to a second position, a resistant device capable of opposing a resistance during the movement of said first and second lever from said first position to said second position, a transmission turn system capable of connecting said first and second lever to said resistant device, said first lever comprising a first reference element, arranged so that, when the user grips said first handle, said first reference element extends below the forearm of the user, in order to act as a reference for the position in which keeping the arm during the execution of the exercise, and said second lever comprising a second reference element, arranged so that, when the user grips said second handle, said second reference element extends below the forearm of the user, in order to act as a reference of the position in which keeping the arm during the execution of the exercise.

Further according to the invention, said first reference element is fixed to said first lever and it is arranged below said first handle, and said second reference element is fixed to said second lever and it is arranged below said second handle.

Preferably according to the invention, said first and second reference element lie in a plane horizontal and parallel with respect to said ground or base.

Still according to the invention, said resistant device is an electromagnetic device, capable of simulating a gravitational or elastic or viscous resistance.

Always according to the invention, said resistant device is a gravitational resistant device.

Finally, according to the invention, said transmission turn system comprises a transmission element, capable of connecting said first and second lever to said resistant device.

BRIEF DESCRIPTION OF THE FIGURES

The present invention will be now described, for illustrative but not limitative purposes, according to its preferred embodiments, with particular reference to the figures of the enclosed drawings, wherein.

DETAILED DESCRIPTION

In the various figures, the similar parts will be indicated with the same numerical references.

Figure 1:
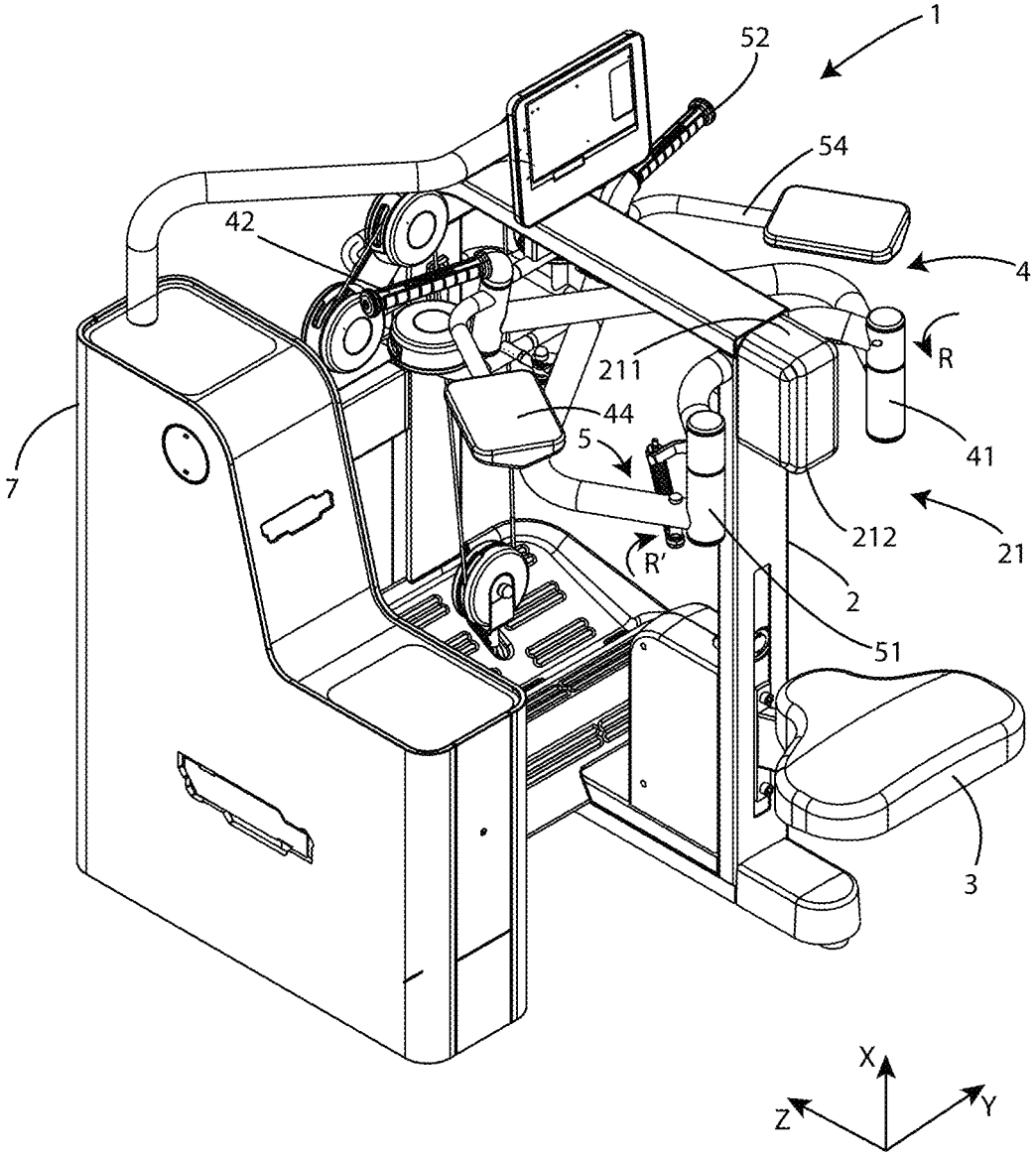
FIG. 1 shows an axonometric view of the gymnastic machine for training the muscles of the trunk and shoulder girdle, comprising improved levers, object of the present invention, provided with a first embodiment of the resistance device.
Figure 2:
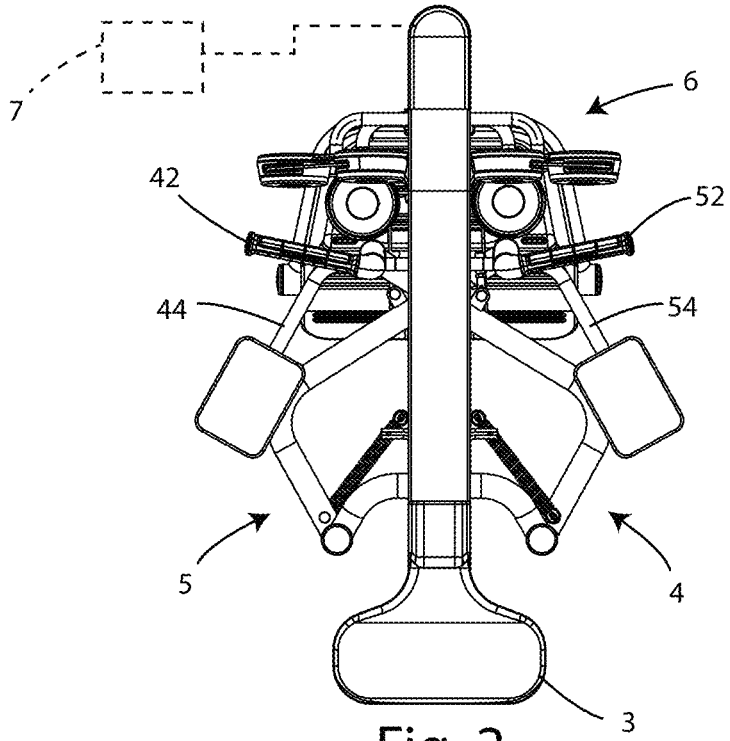
FIG. 2 shows a top view of the machine shown in FIG. 1.
Figure 3:
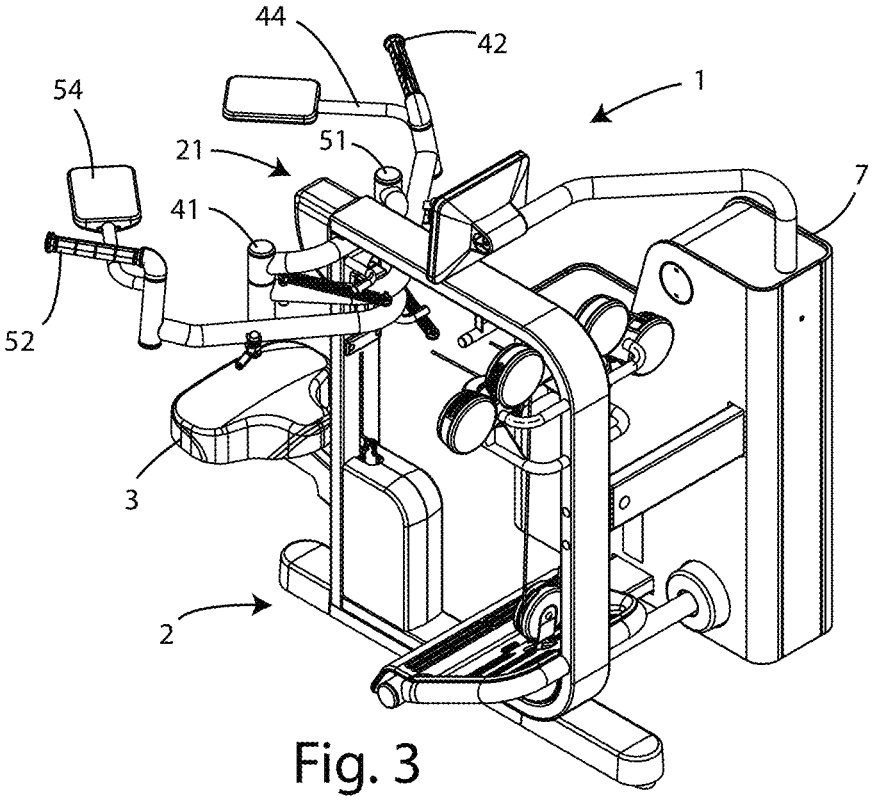
FIG. 3 shows an axonometric view of the machine shown in FIG. 1, in which the improved levers are arranged in a working position.
Figure 4:
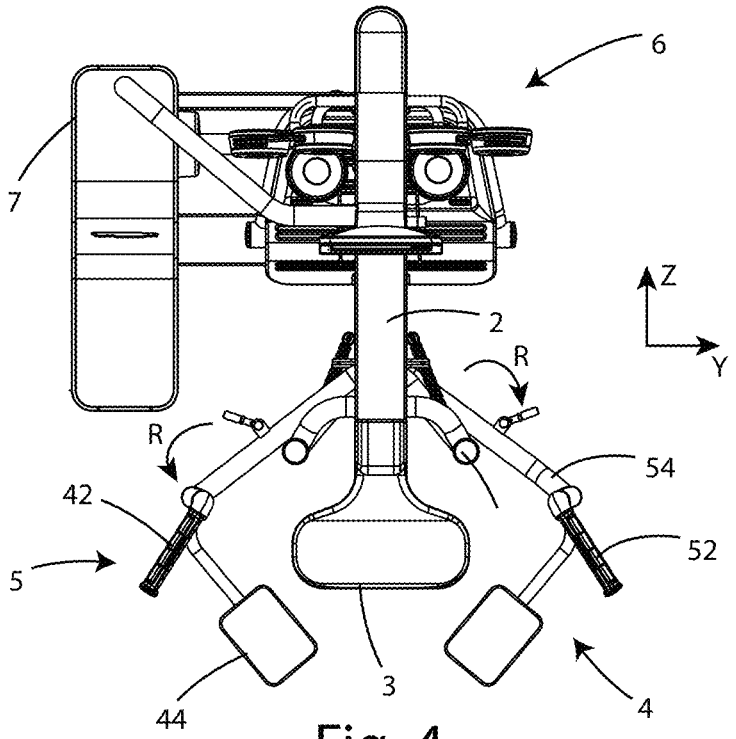
FIG. 4 shows a top view of the machine shown in FIG. 1, in which the improved levers are arranged in a working position.
Figure 5:
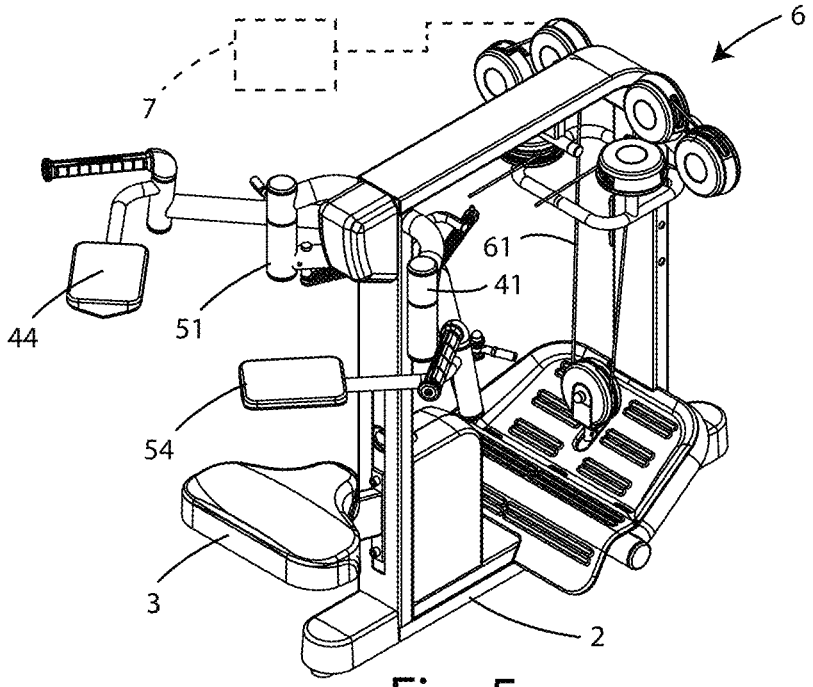
FIG. 5 shows an axonometric view of the machine shown in FIG. 1, in which the improved levers are arranged in a working position.
Figure 6:
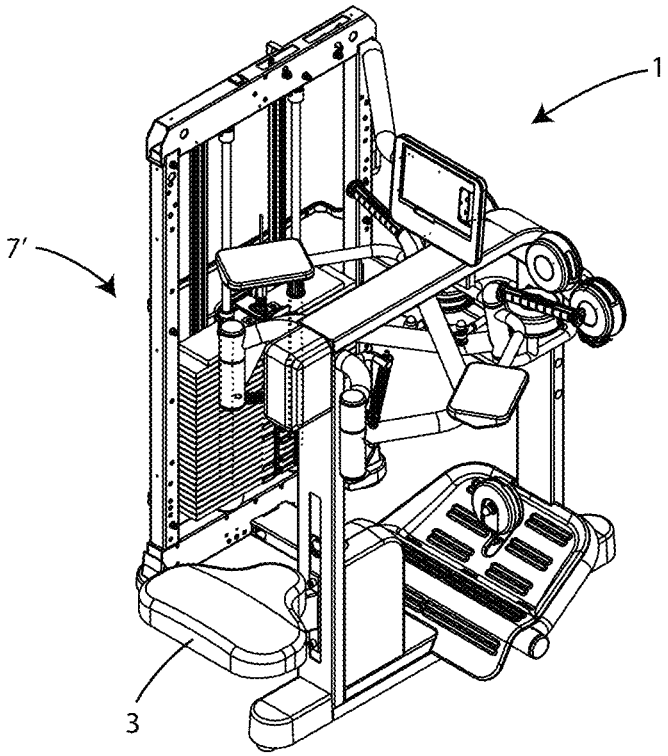
FIG. 6 shows an axonometric view of the machine shown in FIG. 1, provided with a second embodiment of the resistance device.
Figure 7:
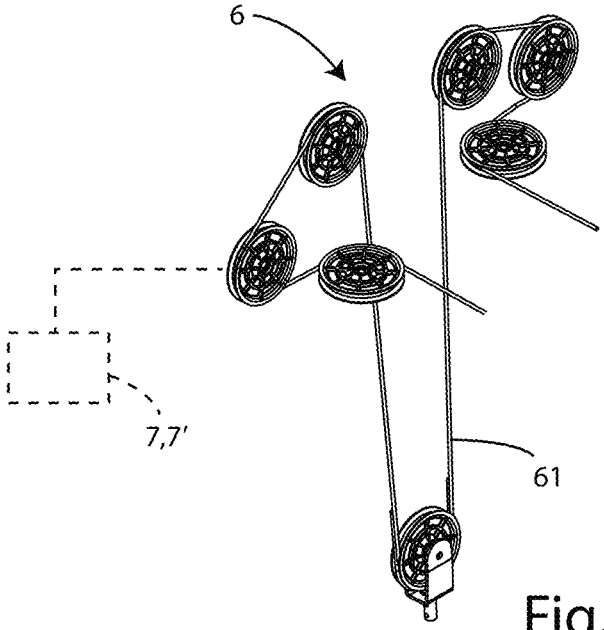
FIG. 7 shows a schematic view of the transmission device of the machine shown in FIG. 1.

Referring to FIG. 1, the gymnastic machine 1 for training the trunk muscles, comprising improved levers, object of the present invention, essentially comprises a frame 2, a seat element 3 coupled to the frame 2, a first lever 4 coupled to the frame 2, a second lever 5 coupled to the frame 2, a transmission system 6, comprising a plurality of pulleys and a transmission element 61, and a resistance device 7.

The frame 2 is capable of resting on the ground or on a base and comprises a plurality of uprights and/or tubular elements connected to each other.

The seating element 3 is a seat to accommodate the user while performing the exercises.

The seat 3 is slidably coupled along a first X axis to said frame 2, so as to change its position, with respect to the ground or the base on which the gymnastic machine is placed, depending on the height of the user.

Said first lever 4 is pivoted to the frame 2 in a first fixed fulcrum 41 and is able to rotate around said first fixed fulcrum 41 from a first position to a second position, according to a first rotation direction R.

Said first lever 4 rotates around an axis, in particular a substantially vertical X axis.

In said first position, said first lever 4 is at rest and is arranged in a substantially distal position with respect to said seat 3.

In said second position, said first lever 4 is in a working position and is arranged in a substantially proximal position with respect to said seat 3.

Said first lever 4 comprises a first handle 42, which can be grasped by the user, to cause the passage from said first position to said second position and vice versa.

Said first lever 4 is connected by means of said transmission element 61 to said transmission system 6.

Said first lever 4 includes a first reference element 44.

Said first reference element 44 lies in a horizontal YZ plane and parallel to the ground or base.

Preferably said first reference element 44 lies in a plane substantially orthogonal to the rotation axis of said first lever 4.

Said first reference element 44 has an elongated and flat shape.

Said first reference element 44 is in particular fixed to said first lever 4 immediately below said first handle 42, so that, when the user grips said first handle 42 to perform the exercise, said first reference element 44 extends below the user's forearm, so as to act as a reference for the position in which keeping the arm during the execution of the exercise.

Said first reference element 44 is fixed with respect to said first lever 4.

In particular, the first reference element 44 is fixed to said first lever 4 below said first handle 42.

During the execution of the exercise, the first reference element 44 is arranged below said first handle 42.

During the rotation of the first lever 4, the first reference element 44 lies in a plane substantially orthogonal to the axis of rotation of the first lever 4.

In particular, during the rotation of the first lever 4, the first reference element 44 lies in a substantially horizontal YZ plane and parallel to the ground or base.

Similarly, said second lever 5 is pivoted on the frame 2 in a second fixed fulcrum 51 and is able to rotate around said second fixed fulcrum 51 from a first position to a second position, according to a second rotation direction R', opposite to said first rotation direction R.

Said second lever 5 rotates around an axis, in particular a substantially vertical X axis.

In said first position, said second lever 5 is at rest and is arranged in a substantially distal position with respect to said seat 3.

In said second position, said second lever 5 is in a working position and is arranged in a substantially proximal position with respect to said seat 3.

Said second lever 5 comprises a second handle 52, which can be gripped by the user, to cause the transition from said first position to said second position and vice versa.

Said second lever 5 is connected via said transmission element 61 to said transmission system 6.

In said first position, said first 4 and second 5 lever assume a configuration in which they are arranged crossed with each other, in particular in which said first lever 4 is arranged raised with respect to said second lever 5.

Said second lever 5 comprises a second reference element 54.

Said second reference element 54 lies in a horizontal ZY plane and parallel to the ground or base.

Preferably, said second reference element 54 lies in a plane substantially orthogonal to the axis of rotation of said second lever 5.

Said second reference element 54 has an elongated and flat shape.

Said second reference element 54 is in particular fixed to said second lever 5 immediately below said second handle 52, so that, when the user grips said second handle 52 to perform the exercise, said second reference element reference 54 extends below the user's forearm, so as to act as a reference for the height at which to hold the arm while performing the exercise.

Said second reference element 54 is fixed with respect to said second lever 5.

In particular, the second reference element 54 is fixed to said second lever 5 below said second handle 52.

During the execution of the exercise, the second reference element 54 is arranged below said second handle 52.

During the rotation of the second lever 5, the second reference element 54 lies in a plane substantially orthogonal to the axis of rotation of the second lever.

In particular, during the rotation of the second lever 5, the second reference element 54 lies in a substantially horizontal YZ plane and parallel to the ground or base.

Said transmission system 6 connects said first 4 and second lever 5 to said resistance device 7, via said transmission element 61, which is in particular a cable.

In a first embodiment, said resistance device 7 is an electromagnetic device, such as an electric motor, capable of simulating different types of resistance such as gravitational, elastic, viscous.

In a second embodiment, said resistance device 7' is a gravitational resistance device, such as a weight stack.

Said frame 2 includes a spacer element 21 arranged higher than said seat 3, so that the user can rest his torso while performing the exercises.

In particular, said spacer element 21 is a cushion that extends along said first axis from a first end 211 to a second end 212, so that the user rests the sternum on said first end 211 and the initial part of the stomach on said second end 212.

Said spacer element 21 has a variable stiffness along said first X axis.

In particular, the resistance of said first end 211, where the user rests the sternum, is greater than the resistance of said second end 212, where the user rests the initial part of the stomach, to avoid any damage to the most sensitive parts of the user's body.

The operation of the gymnastic machine 1 for training the trunk muscles, comprising reference elements, described above, is as follows.

When a user intends to perform a workout for the trunk muscles, in particular the shoulder muscles such as the glenohumeral muscles, scapular muscles, rhomboids, middle trapezius muscles, scapular stabilizers, posterior deltoid, infraspinatus and teres minor, s/he accesses the gymnastic machine 1.

The user sits on said seat 3 and rests the front part of the trunk on said spacer element 21, so that the sternum rests at the height of said first end 211 and the initial part of the stomach rests at the height of said second end 212.

The user holds said first handle 42 of said first lever 4 with the left hand and said second handle 52 of said second lever 5 with the right hand.

Initially said first 4 and second 5 levers are in said first rest position.

The user performs the concentric phase of the exercise by pulling said first 4 and second 5 lever towards her/him, in particular taking them from said first position towards said second position.

Said first lever 4 rotates around said first fixed fulcrum 41, according to said first rotation direction R, while said second lever 5 rotates around said second fixed fulcrum 51, according to said second rotation direction R'.

The transmission system 6 transmits the traction through said cable 61 to said resistance device 7, 7' which opposes a resistance based on the load selected by the user.

Once the concentric phase is completed, the user performs the eccentric phase of the exercise by controlling the removal (induced by the load) of said first 4 and second 5 levers from her/himself and bringing them back from said second position towards said first position.

Throughout the exercise, the user's arms, in particular the elbows, cannot lower with respect to the wrists and the hands gripping said first 42 and second 52 handles respectively, thanks to the presence of said first 44 and second 54 reference elements, which act as a reference to the position in which the arms must be positioned to correctly perform the exercise.

Therefore, the user's upper limbs remain on said YZ plane, thus allowing correct execution of the exercise.

It is also possible that during the execution of the exercise, the user can rest his elbows on said first 44 and second 54 reference elements.

ADVANTAGES

As is evident from the above description, the gymnastic machine comprising improved levers described above allows, through a traction movement on the transverse plane, to adduct the scapulae by specifically activating the rhomboid muscles and the middle bundles of the trapezius, scapular stabilizing muscles really relevant from a postural point of view, as they correct the paramorphic alterations typical of the kyphotic attitude.

Furthermore, during the execution of the exercises, the shoulder extends on the transverse plane activating the extra-rotator muscles of the shoulder, i.e. the posterior deltoid, infraspinatus, and teres minor, which are fundamental muscles for posture, as they correct, for example, the vice posture of internally rotated shoulders, and for active stabilization of the shoulder in static and dynamic conditions, as the infraspinatus and teres minor are muscles of the rotator cuff.

The present invention has been described for illustrative but not limitative purposes, according to its preferred embodiments, but it is to be understood that modifications and/or changes can be introduced by those skilled in the art without departing from the relevant scope as defined in the enclosed claims.

The invention claimed is:

1. A gymnastic machine for training trunk muscles and shoulder cingulum comprising:

- a frame configured to rest the gymnastic machine on a ground or on a base;
- a first lever comprising a first handle configured to be gripped by a user, the first lever being pivotally coupled to the frame at a first fixed fulcrum and configured to rotate around the first fixed fulcrum about a first substantially vertical axis from a first position to a second position;
- a second lever comprising a second handle configured to be gripped by the user, the second lever being coupled to the frame at a second fixed fulcrum and configured to rotate around the second fixed fulcrum about a second substantially vertical axis from a first position to a second position, wherein the rotation of the second lever is opposite to the rotation of the first lever;
- a gravitational resistant device or an electromagnetic device configured to oppose resistance during movement of the first and second levers from their respective first positions to their respective second positions;
- one or more cables configured to connect the first and second levers to the gravitational resistant device or the electromagnetic device;
- a first support surface coupled to the first lever;
- a second support surface coupled to the second lever; and
- a spacer on which a torso of the user rests when the user performs an exercise,
- wherein the first support surface, when the gymnastic machine is in use, is configured to extend below a first forearm of the user, to act as a reference for a position in which a first arm of the user is kept during execution of the exercise, and wherein the second support surface, when the gymnastic machine is in use, is configured to extend below a second forearm of the user, to act as a reference for the position in which a second arm of the user is kept during execution of the exercise.

2. The gymnastic machine of claim 1, wherein the first support surface is fixed to said first lever and the first support surface is arranged below the first handle, and wherein the second support surface is fixed to said second lever and the second support surface is arranged below said second handle.

3. The gymnastic machine of claim 1, wherein the first and second support surfaces lie in a plane (YZ) horizontal and parallel with respect to said ground or base.

4. The gymnastic machine according to claim 1, wherein said electromagnetic device is configured to simulate a gravitational or elastic or viscous resistance.

5. The gymnastic machine according to claim 1, wherein said gymnastic machine comprises the gravitational resistant device.

6. The gymnastic machine according to claim 1, wherein said one or more cables are configured to connect said first and second levers to said gravitational resistant device or said electromagnetic device.

7. The gymnastic machine of claim 1, wherein the spacer is configured to support a front side of the torso of the user when the user performs the exercise.

8. The gymnastic machine of claim 1, wherein the spacer is configured to support a sternum of the user on an upper end of the spacer and an initial part of stomach of the user on a lower end of the spacer.

9. The gymnastic machine of claim 1, wherein the spacer comprises a cushion.

* * * * *